United States Patent [19]

Schauer

[11] Patent Number: 4,756,456

[45] Date of Patent: Jul. 12, 1988

[54] GUN CASE

[76] Inventor: Kent R. Schauer, 9407 Admiral Nimitz NE., Albuquerque, N. Mex. 87111

[21] Appl. No.: 63,415

[22] Filed: Jun. 18, 1987

[51] Int. Cl.[4] ..... F41C 23/02

[52] U.S. Cl. ..... 224/150; 224/913; 224/205; 150/52 R; 206/317

[58] Field of Search ..... 224/915, 913, 205, 232, 224/150, 908, 916, 917; 150/52 R, 52 J, 526, 2; 206/315.11, 317

[56] References Cited

U.S. PATENT DOCUMENTS

| | | | |
|---|---|---|---|
| 3,437,247 | 4/1969 | Gantress | 150/52 R |
| 3,701,371 | 10/1972 | Stackhouse | 150/52 R |
| 3,865,166 | 2/1975 | Pedro | 150/52 R |
| 4,249,687 | 2/1981 | Warnier | 224/913 |
| 4,649,973 | 3/1987 | Uchin | 150/52 J |

*Primary Examiner*—Henry J. Recla
*Assistant Examiner*—David H. Voorhees
*Attorney, Agent, or Firm*—William A. Eklund

[57] ABSTRACT

A gun case for protecting a rifle from the elements while being carried in the field. In the preferred embodiment a pair of elastomeric grommet assemblies fit over the stud posts of conventional sling swivel assemblies so as to permit the rifle to be carried by the sling in a conventional manner while being fully enclosed by the gun case. The grommet assemblies form a substantially watertight seal with conventional swivel assembly stud posts. Although the rifle is at all times fully enclosed by the case, the case may at any time be quickly and easily opened to permit the rifle to be aimed and fired, all without having to detach the case from the rifle.

5 Claims, 6 Drawing Sheets

GUN CASE

BACKGROUND OF THE INVENTION

The invention described and claimed herein is generally related to protective cases for firearms. More particularly, this invention is related to protective carrying cases for rifles.

The present invention is generally applicable to rifles, shotguns and other firearms that may be carried by means of a shoulder sling. However, the primary use of the invention is to protect hunting rifles while being carried in the field. Accordingly, as a matter of convenience in the following specification, the invention will be described primarily with reference to rifles.

The present invention is directed to the problem of adequately protecting a hunting rifle from foul weather while the rifle is being carried in the field, while at the same time allowing the rifle to be carried in a comfortable manner and at the same time maintaining the rifle in a state of readiness that is sufficient to allow it to be quickly deployed and fired when game is sighted. It will be recognized that it is important to protect the metal parts of a hunting rifle from the effects of moisture, particularly on extended hunts when regular maintenance may not be feasible.

There have been commercially available various carrying cases for rifles and shotguns. Most such cases, however, are designed for storage of the firearm, or for transportation of the firearm to and from the field or range, but have not been designed for the purpose of carrying the firearm in the field while hunting. As a result, such cases are not generally suitable for use in the field. Some such cases are of rigid construction, rendering them bulky and altogether unsuitable for use in the field. Many commercially available cases are of a soft construction, and are somewhat better suited for carrying the rifle, but such cases typically do not allow the rifle to be carried by a shoulder sling while the rifle is in the case, and further do not allow the rifle to be sighted and fired without first having to remove the rifle from the case. Additionally, soft cases are simply two bulky and cumbersome for use in the field, particularly while traveling on foot.

Furthermore, most commercially available soft rifle cases include zippers that extend all or part of the length of the case. In this regard, it well known that zippers are designed to bear only a limited amount of stress in a direction transverse to the plane of the fabric to which they are attached. Accordingly, it is recognized that it is undesirable for a zipper to be located on the underside of a gun case, where the zipper would bear the full weight of the rifle directly. Consequently most soft gun cases are designed so that the zipper faces upwardly while the rifle is being transported. Typically in this regard there is a handle attached to the case on the same side as the zipper, so that the zipper faces upwardly during carrying of the case and rifle by the handle of the case, thereby ensuring that the rifle cannot damage the zipper and possibly be dropped from the case due to a failure of the zipper. Although such a design is structurally sound for the limited purpose of transporting the rifle to and from the field, it suffers from the disadvantage that the upwardly facing zipper allows rain to enter the gun case through the upwardly facing zipper during normal carrying of the rifle. In this regard, it is well known that it is difficult, if not impossible, to provide a zipper that is impermeable to water. As a result, this design is unsuitable for any kind of extended use during foul weather. Moreover, this design requires that the rifle and case be carried by the case handle, rather than by the more efficient and comfortable shoulder sling, which is normally attached to the rifle and therefore enclosed within the case along with the rifle. During any but the briefest of hunts this consequence of the case design ordinarily represents an unacceptable inconvenience.

In perhaps the majority of instances, no gun case at all is used by hunters in the field. Nevertheless, there has been a need for a means of protecting high quality hunting rifles while being carried in the field. More particularly, there has been a need for a carrying case that can be conveniently used in the field to protect a high quality rifle, particularly when foul weather is expected, or during extended hunts. During extended hunts lasting several days, even small amounts of water can cause damage, particularly if the water gains access to the internal mechanisms of the rifle.

Accordingly, it is an object and purpose of the present invention to provide a carrying case for a rifle or other firearm, which is substantially impermeable to water, and which is durable, compact and light weight.

It is also an object and purpose of the present invention to provide a carrying case for use in the field, which permits the rifle, to be carried by a conventional shoulder sling attached to the rifle.

It is another object and purpose of the present invention to provide a carrying case for a rifle, which allows the rifle to be quickly aimed and fired without being detached from the carrying case.

It is yet another object and purpose of the present invention to provide a carrying case for a rifle which does not include a zipper that faces upwardly during normal carrying of the case and the rifle.

SUMMARY OF THE INVENTION

In accordance with the present invention, there is provided a gun case that is particularly adapted to allow a rifle to be carried in the field. The gun case includes a flexible casing which is foldable about the rifle, and fastening means, preferably a zipper, for closing the case about the rifle. The gun case further includes first and second apertures which are positioned along the fold line of the case and which are spaced apart by a distance approximately equal to the distance between the sling swivel assemblies of a conventional hunting rifle. The apertures permit the rifle to be attached to and carried by its shoulder sling while enclosed in the case, thereby protecting the rifle from the elements while being carried in the field by its shoulder sling.

In the preferred embodiment, the apertures include elastomeric grommet assemblies. Each grommet assembly includes a pair of elastomeric disks having central bores that are sized to receive the stud posts of conventional rifle sling swivel assemblies. The disks are bonded together and are centered on holes in the casing. By inserting the stud posts through the grommet assemblies, a rifle may be carried in the field by its sling in a conventional manner, while completely enclosed in the case. The grommet assemblies form watertight seals with the stud posts to prevent moisture from entering the case.

These and other aspects of the invention will be more apparent upon consideration of the following detailed description of the invention and the accompanying drawings.

BRIEF DESCRIPTION OF THE DRAWINGS

The accompanying Figures are incorporated in and form a part of the present specification and, when taken with the following detailed description, serve to describe and illustrate the preferred embodiment of the present invention.

In the Figures.

DETAILED DESCRIPTION OF THE PREFERRED EMBODIMENT

Figure 1:
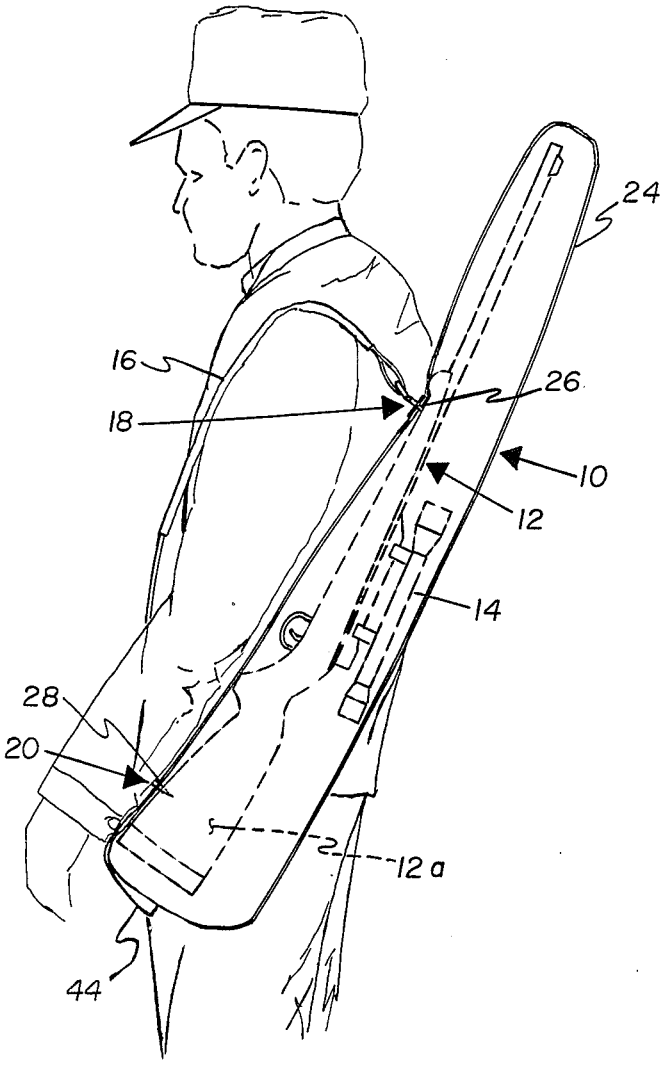
FIG. 1 is a side view illustrating the gun case of the present invention, together with an enclosed hunting rifle shown in phantom outline, being carried in the field.

Referring first to FIG. 1, there is illustrated a gun case 10 made in accordance with the present invention, and which is illustrated as it is used to enclose and protect a conventional hunting rifle 12 being carried in the field. The rifle 12 is equipped with conventional telescopic sight 14 and shoulder sling 16. The sling 16 is attached to the wooden stock 12*a* of the rifle 12 by means of two sling swivel assemblies 18 and 20. It will be understood that the hunting rifle 12 and its various components form no part of the present invention.

Figure 2:
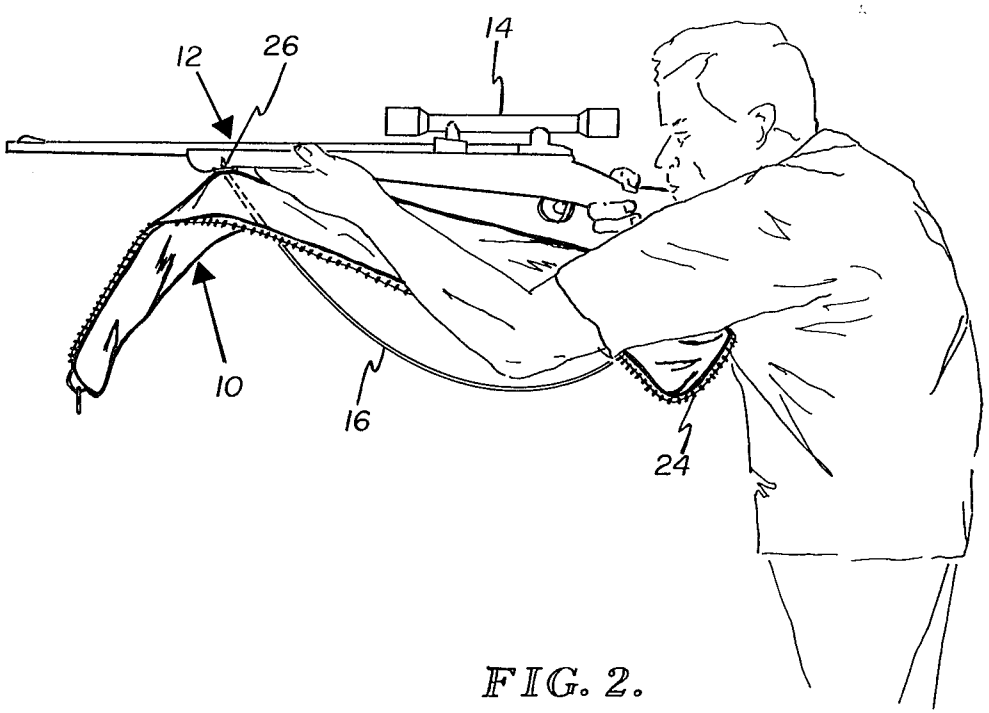
FIG. 2 is a side view of the hunting rifle being aimed for firing, with the gun case unfolded from about the rifle but still attached thereto and depending therefrom.
Figure 3:
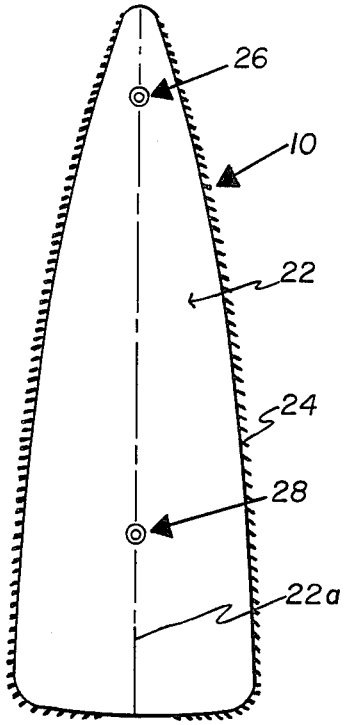
FIG. 3 is a plan view of the gun case unfolded and open.

Referring to FIGS. 1 through 3, the gun case 10 includes an elongate flexible casing 22 that is preferably made of a water repellent or water impermeable fabric. Most preferred is a fabric which is breathable and permeable to air and water vapor, but which is impermeable to liquid water. Such fabrics are commercially available and are sold, for example, under the trademark Goretex.

The casing 22 is cut so that when folded in half it is of a size and shape suitable to enclose the rifle 12. A zipper 24 fastens the edges of the casing 22 to complete the enclosure of the rifle.

As shown in FIG. 3, the gun case 10 includes two substantially identical grommet assemblies 26 and 28, which are positioned along the fold line 22*a* of the gun case 10 and are spaced apart by a distance approximately equal to the distance between the sling assemblies 18 and 20 of the rifle.

Figure 4:
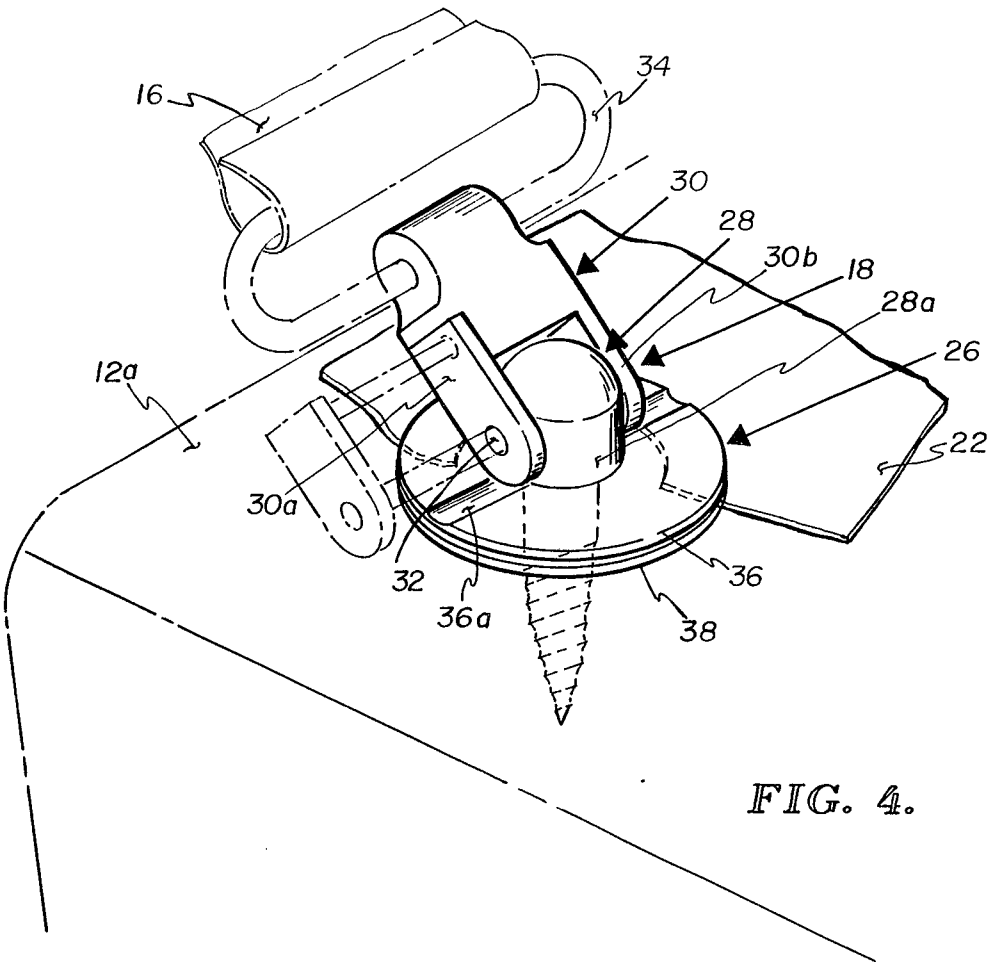
FIG. 4 is an isometric view illustrating one watertight grommet assembly of the case and its relationship to a sling swivel assembly attached to the rifle.
Figure 6:
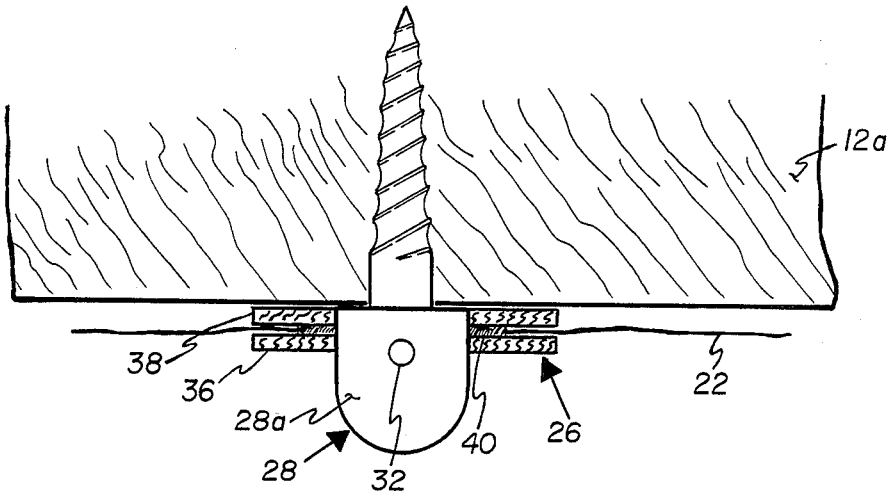
FIG. 6 is a side view in partial cross section of the grommet and sling swivel assemblies.
Figure 5:
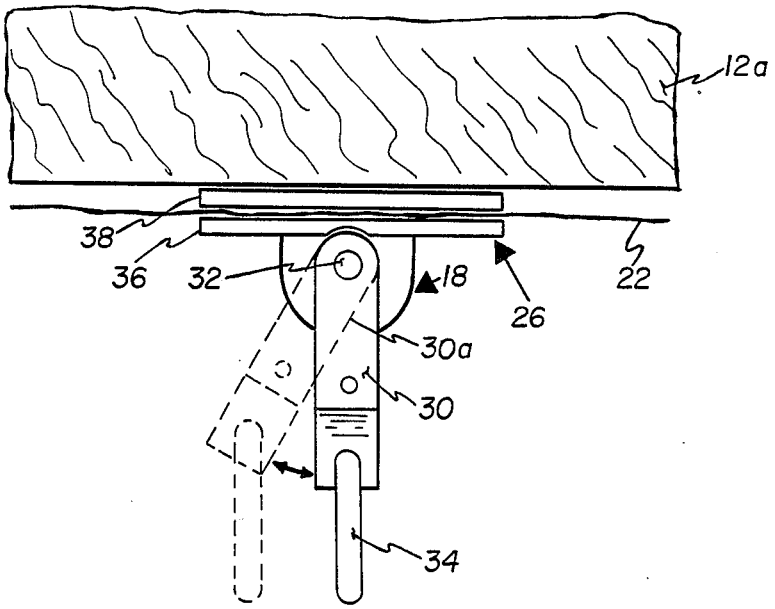
FIG. 5 is a side view in partial cross section of the grommet and sling swivel assemblies.

FIGS. 4, 5 and 6 illustrate details of the front swivel assembly 18 and the front grommet assembly 26. It will be understood that the details of the construction of these elements are substantially the same as the details of construction of the rear swivel assembly 20 and the rear grommet assembly 28.

Referring to FIGS. 4, 5 and 6, the swivel assembly 18 includes a stud post 28 which is threaded into the wood rifle stock 12*a*. The stud post 28 includes a head 28*a* which is generally cylindrical along a portion of its length and which has a hemispherical end surface. A swivel member 30 is pivotably attached to the head 28*a* by means of a pivot pin 32. The rifle sling 16 is attached to a retaining ring 34, which in turn is attached to the swivel member 30.

The swivel member 30 includes two arms 30*a* and 30*b* which extend alongside the head 28*a* of the stud post 28. In accordance with the well known construction of the swivel member 30, one arm, 30*a*, is integrally attached to the pivot pin 32 and is extendable from the body of the swivel member 30, whereby the arm 30*a* and pivot pin 32 may by manually withdrawn from the bore of the stud post head 28*a* so as to permit removal of the swivel member from the head 28*a*. The arm 30*a* is spring biased toward the closed position shown in the Figures. The arm 30*a* is shown in the extended position in phantom outline in FIG. 4.

The grommet assembly 26 includes two circular, elastomeric disks 36 and 38 which are bonded to one another by a suitable cement 40, and which sandwich the fabric casing 22. The disks are preferably formed of neoprene rubber. The disks 36 and 38 include concentric central circular bores which are each sized so that the disks 36 and 38 snugly encircle the cylindrical portion of the stud post head 28*a* to form an essentially watertight seal between the bonded disks 36 and 38 and the stud post head 28*a*.

The disks 36 and 38 are centered on a circular hole which is formed in the fabric casing 22. The hole in the casing 22 is somewhat larger than the bores in the two disks 36 and 38, so that the two disks may be bonded directly together with the cement 40 over at least a portion of their facing surfaces. This enables a stronger bond to be formed than would be possible if each of the disks were cemented only to the fabric casing 22, particularly if the casing is formed of a water repellent fabric having a coating of polytetrafluoroethylene, which is notable for its resistance to adhesive bonding.

In the case of neoprene disks, for example, it is possible to cement the disks directly together with certain cements which form a bond that is essentially as strong as the neoprene disks themselves. This construction serves to securely locate and fasten the disks 36 and 38 to the casing 22 as well as to one another.

The outer disk 36 includes a concave diametrical groove 36*a* formed in its outer surface (FIG. 4). The groove 36*a* receives the cylindrically curved ends of the arms 30*a* and 30*b* of the swivel member 30, as shown best in FIG. 5. This arrangement allows the disks 36 and 38 to be sized in thickness so that the arms 30*a* and 30*b* may be used to urge the disks 36 and 38 against the rifle stock 12*a* when the swivel member 30 is attached to the stud post 28, while at the same time allowing the swivel member 30 to pivot about the pivot pin 32. This arrangement results in the grommet assembly 26 being slightly compressed by the swivel member arms 30*a* and 30*b*, to thereby slightly compress the disks 36 and 38 about the stud post head 28 and render the seal therebetween even more watertight.

Figure 7:
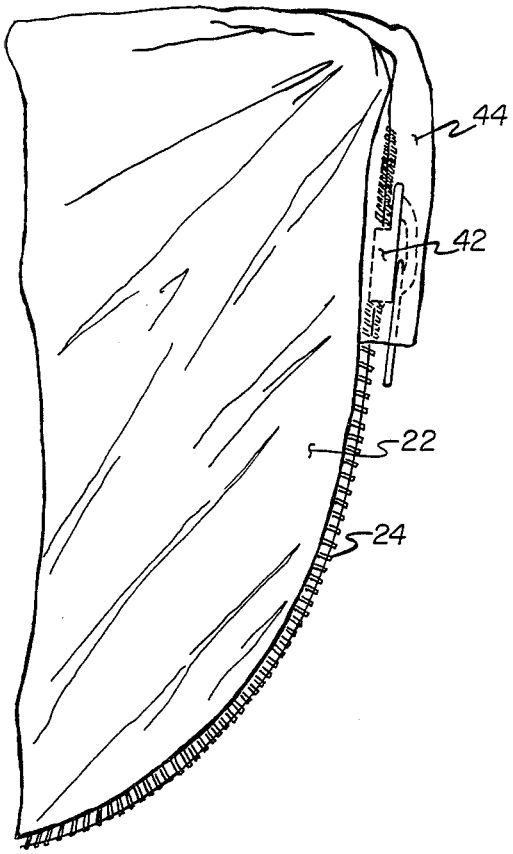
FIG. 7 is an isometric view illustrating details of the construction of the butt end of the gun case.

The case 10 is normally carried in the field in the manner shown in FIG. 1, with the butt ends of the rifle and the case pointing generally downwardly and forwardly. A zipper member 42 is normally positioned at the upper end of the butt of the case, as shown in FIG. 7. To further ensure that in this position maximum water impermeability is obtained, the butt end of the case is constructed to include a downwardly opening zipper pocket 44 into which the zipper member 42 is inserted when the case is closed. The zipper pocket 44 effectively prevents water from leaking into the case in the vicinity of the zipper member 42 while the case is closed and being carried in the manner shown in FIG. 1.

In use, the gun case 10 is ordinarily carried in the field in the manner shown in FIG. 1, with the rifle 12 enclosed in the case and the rifle sling 16 being used in its ordinary manner to carry the rifle, and with the rifle barrel pointed upwardly and rearwardly. In this position, the zipper 24, which is the least watertight element of the case, is always facing downwardly, so as to minimize the amount of water that can enter the case through the zipper 24. In this same position the grommet assemblies 26 and 28, which are more watertight than the zipper 24, face generally upwardly.

It will be recognized that the rifle can be aimed and fired without necessity of the gun case 10 being removed from the rifle. The case is simply opened and allowed to hang downwardly, out of the way, while the rifle is aimed and fired, as shown in FIG. 2. The rifle may be conveniently carried for hours, or even days, protected by the case at all times from foul weather, yet the case may be quickly and easily opened and the rifle deployed when necessary. In clear weather the gun case may be removed from the rifle altogether, and folded compactly to be carried in a pack or even in one's pocket.

Although the rifle may be easily deployed without having to detach the case, the case is nevertheless easily detached from the rifle when desired. This is done by merely removing the swivel members 30 from the stud post heads 28, which is easily done in a conventional manner by retracting the extendable arms of the swivel members, and slipping the grommet assemblies 26 and 28 off of their respective stud post heads.

Although the present invention is described and illustrated herein by reference to the preferred embodiment of the invention, it will be recognized that certain variations, modifications and substitutions, which may be apparent to one of ordinary skill in the art, may be made without departing from the essential invention. Accordingly, the present invention is defined by the following claims.

The invention for which patent protection is claimed is:

1. A gun case comprising an elongate flexible casing formed of a substantially water-impermeable fabric, said casing being sized and shaped to fold about a firearm along a central fold line, zipper means for fastening the opposing edges of said casing to enable complete enclosure of a firearm in said casing, said casing including first and second apertures positioned along said fold line and passing through said casing, said apertures being spaced apart and sized in diameter so as to receive passing therethrough sling swivel stud post heads attached to the firearm, first and second grommet assemblies fastened to said casing at said first and second apertures respectively, each of said grommet assemblies including an inner elastomeric disk and an outer elastomeric disk positioned respectively on the inner and outer surfaces of said casing, each of said disks of each grommet assembly including a substantially circular central bore sized to snugly receive a sling swivel stud post head passing therethrough, said apertures of said casing being larger in diameter than said bores in said disks and smaller in diameter than the outside diameters of said disks, and inner and outer disks of each grommet assembly being bonded directly to one other over their facing surfaces with said bores and said aperture in said casing being concentrically aligned, and with a portion of said casing adjacent said apertures being sandwiched between said inner and outer disks of each grommet assembly, whereby said sling swivel stud post heads pass through said grommet assemblies casing in a watertight sealing relationship so as to allow a sling to be attached to said firearm while said firearm is completely enclosed in the case.

2. The gun case defined in claim 1 wherein said outer disk of each of said grommet assemblies includes a diametrically extending, cylindrically curved groove formed in the outer surface of said outer disk, said groove being sized to receive cylindrically curved arm ends of a sling swivel member, whereby the swivel member can pivot about said stud post head while at the same time compressing said disks to form a substantially watertight seal between said grommet assembly and said stud post head.

3. The gun case defined in claim 2 wherein said elastomeric disks of said grommet assemblies are formed of neoprene rubber.

4. The gun case defined in claim 3 wherein said casing includes a downwardly facing zipper pocket at the butt end of the casing to receive a zipper member and to prevent water from entering the case in the vicinity of said zipper member when said case is closed.

5. The gun case defined in claim 4 wherein said substantially water-impermeable fabric includes a coating of polytetrafluoroethylene.

* * * * *